United States Patent [19]

Fogel

[11] 4,149,286

[45] Apr. 17, 1979

[54] WATERBED SAFETY LINER

[75] Inventor: Isaac Fogel, Silver Spring, Md.

[73] Assignee: Classic Products Corporation, Beltsville, Md.

[21] Appl. No.: 865,931

[22] Filed: Dec. 30, 1977

[51] Int. Cl.[2] ..... A47C 27/08; A61F 5/04

[52] U.S. Cl. ..... 5/370; 5/339; 24/201 C

[58] Field of Search ..... 24/205.1 C, 201 C; 5/365, 368–371, 339; 190/41.2; 2/96

[56] References Cited

U.S. PATENT DOCUMENTS

| | | | |
|---|---|---|---|
| 2,119,621 | 6/1938 | Ferrone | 2/96 |
| 3,663,973 | 5/1972 | Spence | 5/355 |
| 3,737,930 | 6/1973 | Smith | 5/355 |
| 4,055,867 | 11/1977 | Phillips | 5/368 |

*Primary Examiner*—Casmir A. Nunberg
*Attorney, Agent, or Firm*—Anne M. Kornbau

[57] ABSTRACT

A waterproof waterbed safety liner is disclosed which completely encloses a waterbed mattress. The waterbed safety liner comprises top and bottom sheets welded together, wherein the top sheet has an opening for inserting the waterbed mattress, and a waterproof zipper closure for sealing the mattress in the safety liner. Should the waterbed mattress leak, the safety liner will prevent the water from spilling on the surrounding floor surface.

5 Claims, 2 Drawing Figures

WATERBED SAFETY LINER

BACKGROUND OF THE INVENTION

The present invention relates to a waterbed liner, and, in particular, to a waterbed liner of improved construction which will hold the water contents of a waterbed mattress should the mattress leak.

It is well known that one of the major problems with waterbed installation is the danger of a water leak. The problem has become so publicized that many apartment building owners will not allow waterbeds above the first floor. Waterbed mattresses are usually well constructed and in most situations do not leak unless abused. On those rare occasions when a waterbed mattress does leak, it behooves a person who uses a waterbed to have some protective means for containing the water.

The prior art patent issued to Kuss, U.S. Pat. No. 3,761,974, is directed to a waterbed construction which includes a waterbed liner of a waterproof vinyl which fits under a waterbed mattress and covers part or all of the sides of the mattress. In general, this type of waterbed liner works well to contain a water leak if a person is not lying on the bed. However, if a person is on the bed, not only will he get wet, but his body will displace some of the water, spilling it out of the liner.

The prior art patent issued to Carson, U.S. Pat. No. 3,736,604, discloses a waterbed liner which fits within the frame of a waterbed to protect against leaks. The waterbed mattress is placed in the liner and covered with a sheet. Both the liner and cover sheet are secured to the frame forming a sealed protective means for the mattress. The Carson device is limited to a waterbed of a particular design for securing the liner and cover sheet to the frame. Without the unique design of the frame the liner and cover sheet would not enclose the mattress.

The patent to Alsbury, U.S. Pat. No. 3,742,531, is concerned with a plastic frame and waterbed mattress combination where the waterbed is enclosed by a covering. The covering has a zipper on its top surface which extends along one end and part way up the two adjacent sides. According to the description in the Alsbury patent, should the waterbed mattress leak the water will be contained within the recess formed by the frame, and any water spilling over the perimeter of the frame would be contained within the cover. There are no reasons given as to ways the spilled water will be contained within the cover or why the water will not leak out through the zipper, which is not stated to form a waterproof seal. However, it appears that the water spilling over the perimeter of the frame is actually trapped in the plastic mattress positioned below the frame.

A cover of some interest to the present invention is disclosed in U.S. Pat. No. 3,737,930, issued to Smith. The patent is directed to a therapeutic cushion which includes a gel pad that may or may not be covered by an inner cover and an outer cover. The outer cover is made of any one of a number of materials, which includes latex rubber or a synthetic elastomeric composition. A zipper is shown in the drawings extending along one side end and partially along the two adjacent side ends. Other than describing the cover with an access slot and a suitable zipper, there is no description of the cover or zipper, except that the cover is not essential.

The present invention is constructed to prevent any water spillage and to protect a person on the waterbed from getting wet.

SUMMARY OF THE INVENTION

It is an object of this invention to provide a waterbed mattress safety liner which completely encloses a waterbed mattress.

It is another object of this invention to provide a waterbed mattress safety liner which will contain the water leaked from a waterbed mattress.

It is a further object of this invention ro provide a waterbed mattress safety liner with a zipper opening whereby the zipper can be sealed against leakage.

It is also an object of this invention to provide a waterbed mattress safety liner of heavy duty construction.

The waterbed mattress safety liner of this invention includes a top sheet and a bottom sheet joined by side walls. The top wall has a longitudinal opening which is closed by a zipper arrangement. The safety liner is made of a waterproof vinyl plastic and all seams are double welded to protect against possible leaks.

DESCRIPTION OF THE PREFERRED EMBODIMENT

Figure 1:
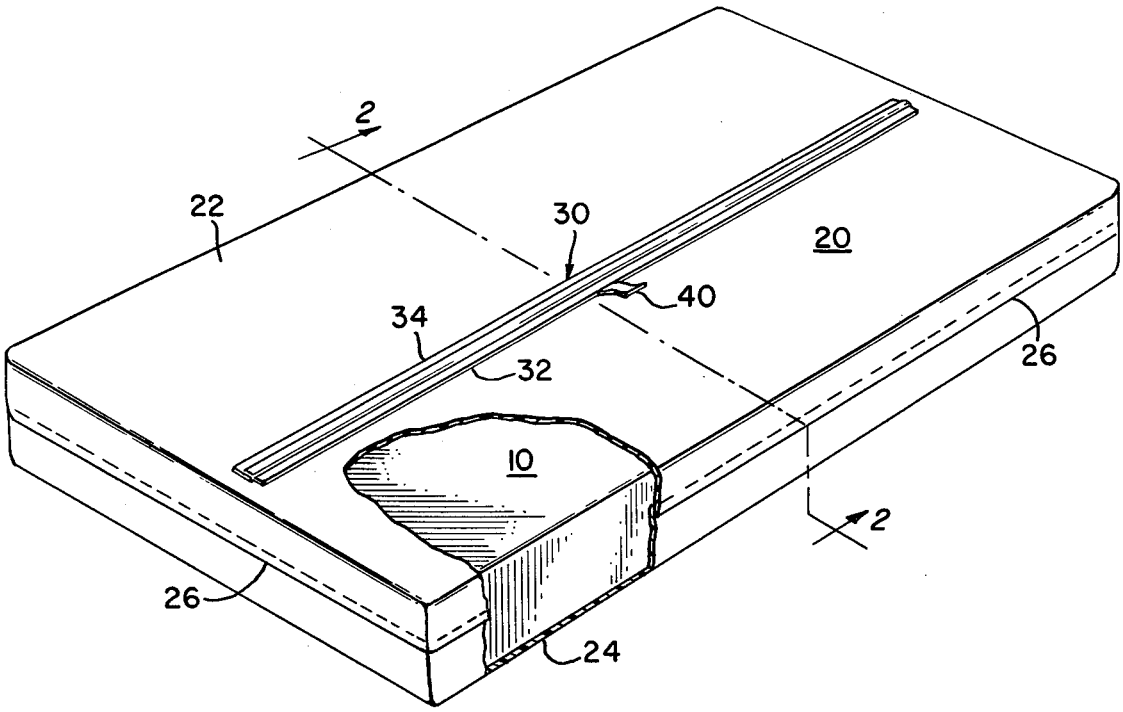
FIG. 1 is a perspective view of a waterbed mattress safety liner of the invention.

Referring to FIG. 1, there is shown a waterbed mattress 10 and a waterbed mattress safety liner 20. The safety liner 20 has a longitudinal opening closed by a zipper 30.

Figure 2:
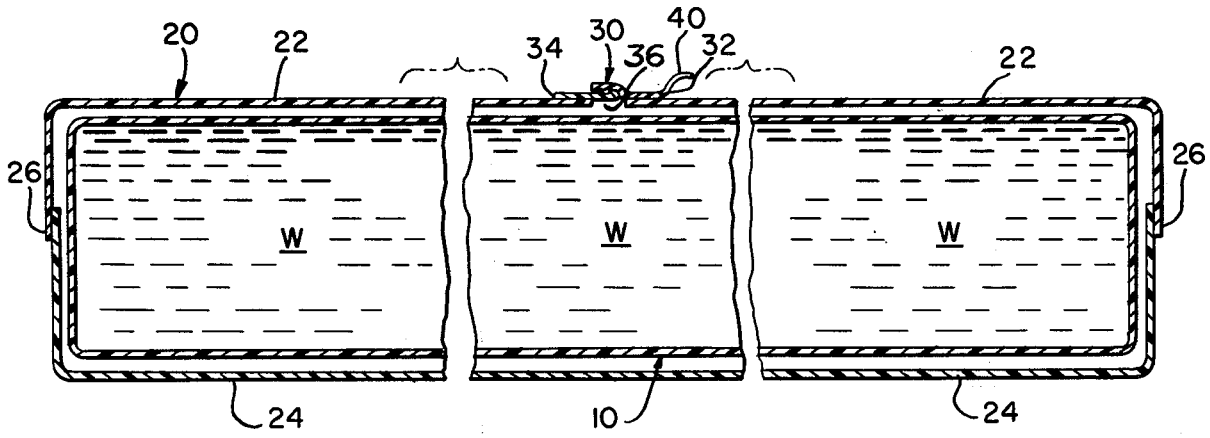
FIG. 2 is a cross-sectional exploded view along the line 2—2 of FIG. 1.

In FIG. 2, the safety liner 20 is shown in cross-section, with the various elements separated to more clearly show the construction of the safety liner with safety liner 20 completely enclosing the waterbed mattress 10. As shown, the safety liner 20 includes a top sheet 22 and a bottom sheet 24. The top sheet 22 and the bottom sheet 24 are thermally welded together along their peripheral edges 26 where they overlap. Each of the welds is a double weld, not shown, to insure that the safety liner will not leak. The top sheet 22 has a zipper closure 30 which seals a longitudinal opening 36 in the center of the sheet. The opening is provided to allow the waterbed mattress 10 to be inserted in the safety liner 20, and to allow the waterbed mattress 10 to be filled with water and sealed by closing the zipper closure 30.

The zipper closure 30 is of a heavy duty molded plastic with tongue and groove connection elements 32 and 34, or some other water-tight construction. There is also provided a pull 40 for separating the tongue and groove connection elements. It is preferred that the zipper closure 30 be double welded to the top sheet 20 along the peripheral edges of the opening 36.

The safety liner 20 is made of a 20 mil vinyl plastic, or some other waterproof plastic material.

Once the waterbed mattress 10 has been placed in the safety liner 20 and filled with water, the zipper closure is sealed by pressing the tongue and groove elements 32 and 34 together. If a leak develops in the waterbed mattress 10, the safety liner is sealed water tight and will contain the water until it can be safely removed.

Although only one specific embodiment of the waterbed safety liner has been described and illustrated in the drawings, it will be understood that various modifications and changes may be made by those skilled in the art without departing from the inventive concept. Reference should therefore be had to the appended claims for a definition of the scope of the invention.

What is claimed is:

1. A waterbed mattress safety liner for completely enclosing a water filled waterbed mattress comprising: a bottom sheet, a top sheet, said bottom sheet and said top sheet thermally welded together to form a waterproof envelope for holding a waterbed mattress, a longitudinal opening in said top sheet, a watertight closure means in said top sheet to close said longitudinal opening, and said safety liner being a waterproof material to contain the water from a waterbed mattress in case of a leak.

2. A waterbed safety liner as claimed in claim 1 wherein said closure means is a zipper closure.

3. A waterbed mattress safety liner as claimed in claim 2 wherein said zipper closure forms a waterproof seal.

4. A waterbed mattress safety liner as claimed in claim 1 wherein said top sheet and said bottom sheet are of a waterproof vinyl plastic of 20 mil thickness.

5. A waterbed safety mattress as claimed in claim 2 wherein the zipper closure is of heavy duty molded plastic with tongue and groove construction elements.

* * * * *